United States Patent [19]

Van Rossem et al.

[11] 4,094,209

[45] June 13, 1978

[54] LEVER KNOB

[75] Inventors: Richard Van Rossem, Canton; Michael B. Hyde, Pekin, both of Ill.

[73] Assignee: Caterpillar Tractor Co., Peoria, Ill.

[21] Appl. No.: 778,653

[22] Filed: Mar. 17, 1977

[51] Int. Cl.[2] ..... G05G 1/10

[52] U.S. Cl. ..... 74/543; 16/110 R

[58] Field of Search ..... 74/543, 557, 553, 504, 74/491, 523; 16/110 R

[56] References Cited

U.S. PATENT DOCUMENTS

| | | | |
|---|---|---|---|
| 2,429,731 | 10/1947 | Roachell | 74/543 |
| 2,801,118 | 7/1957 | Amesbury | 74/543 UX |
| 3,665,785 | 5/1972 | Moal | 74/543 |
| 3,742,204 | 6/1973 | Price | 74/543 X |
| 3,941,009 | 3/1976 | Brown | 74/543 X |

*Primary Examiner*—Clarence R. Gordon

*Attorney, Agent, or Firm*—Wegner, Stellman, McCord, Wiles & Wood

[57] ABSTRACT

A knob assembly for use, either singly or in pairs, has portions of two shaped members seated in face-to-face relationship in an opening in an operating lever. One of said members has an extension which projects substantially across the axial end of the lever so as to protect said end of the lever.

15 Claims, 3 Drawing Figures

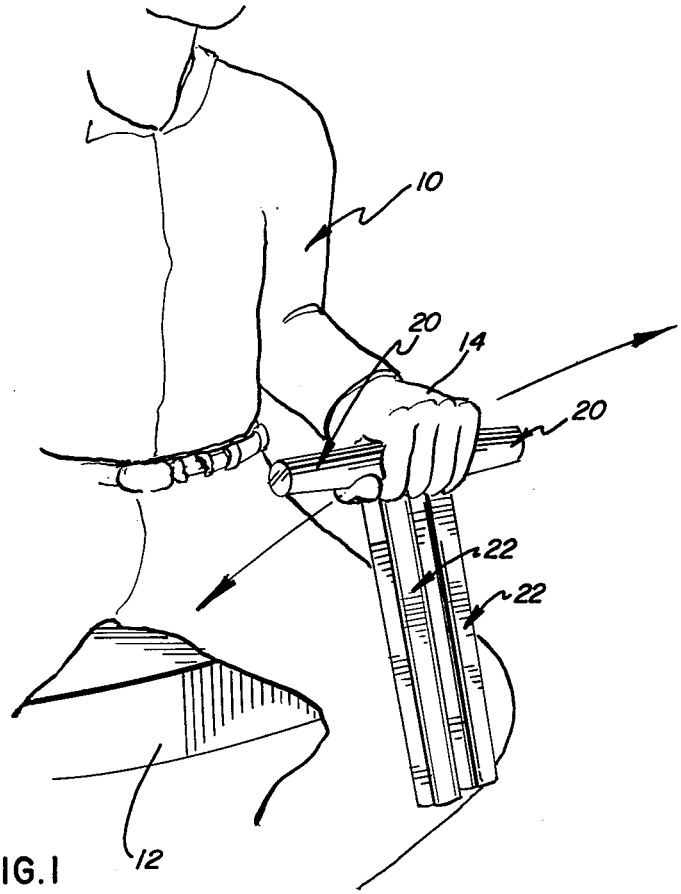
FIG.1
FIG.2
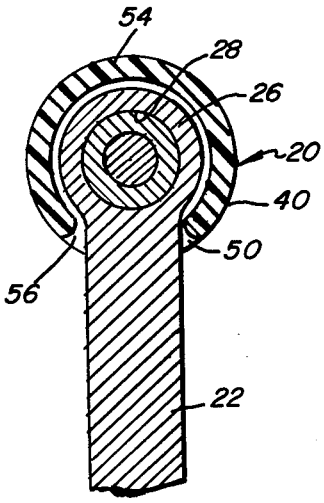
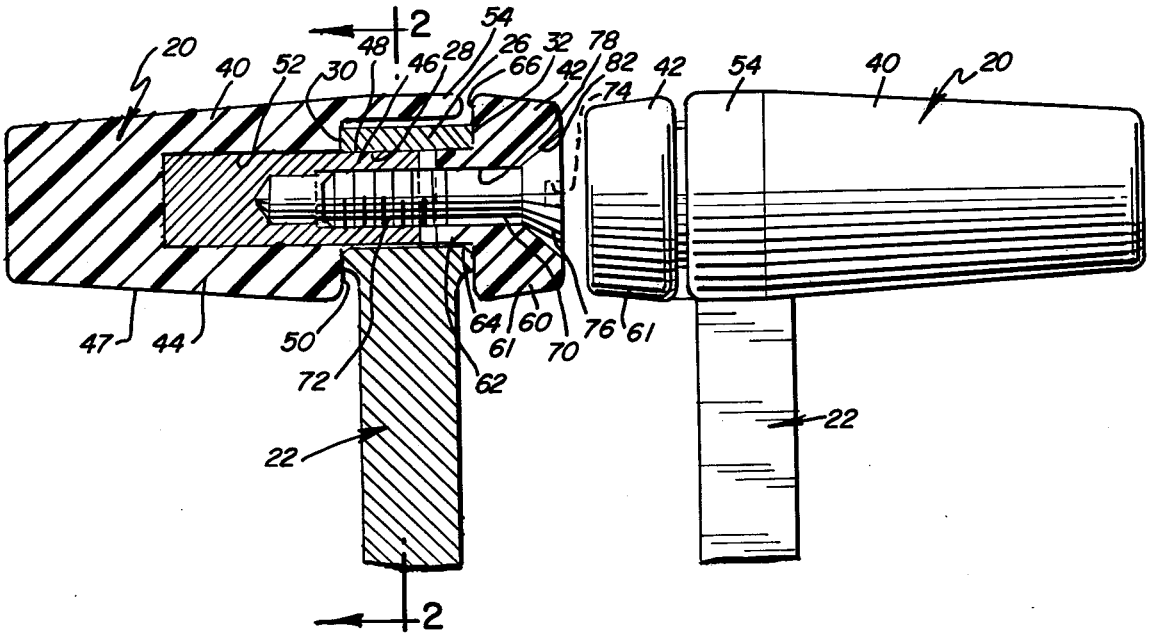
FIG.3

LEVER KNOB

BACKGROUND OF THE INVENTION

1. Field of the Invention

This invention relates to a knob assembly and, more particularly, to a knob assembly having an extension protecting the end of a lever upon which the knob assembly is affixed.

2. Description of the Prior Art

In tractors, bulldozers, and other types of equipment, one or two side-by-side handles or knobs are provided on actuating levers for use in maneuvering or operating the vehicle. In one design, ball-type knobs are provided on the levers. Since it is only possible to grasp one ball at a time, it is necessary to use two hands if both levers are to be operated simultaneously. To overcome the just enumerated problems with ball-shaped knobs, horizontally disposed, cylindrically-shaped knobs have been provided. The two knobs and levers are located side-by-side in aligned relationship such that an operator can operate the two knobs and levers simultaneously with the same hand or he can operate one or the other knob and lever separately. Each cylindrically-shaped knob consists of two members which are assembled together through an opening in the end portion of the lever creating a sandwich structure with the two members of each knob being on opposite sides of the lever. The resulting assembly had the end of the lever substantially flush with the two members of the knob such that use of the assembly eventually wore off the finish on the end of the lever resulting in rusting, and the like, on said lever end.

SUMMARY OF THE INVENTION

The present invention is directed to overcoming one or more of the problems set forth above.

According to the present invention, one of the two members of each knob assembly has an integrally formed extension which encompasses or encircles the end of the lever so that the operator's hand does not contact the end of the lever. In this way, the end of the lever is prevented from rusting and deteriorating. In addition, the knob assembly presents a continuous color to the viewer so as to be aesthetically more appealing.

When two knobs are positioned side-by-side on the ends of adjacent levers, they can be simultaneously actuated by one hand, or individually actuated, as the case may be.

BRIEF DESCRIPTION OF THE DRAWINGS

The details of construction and operation of the invention are more fully described with reference to the accompanying drawings which form a part hereof and in which like reference numerals refer to like parts throughout.

In the drawings:

FIG. 1 is a schematic illustration of a pair of side-by-side levers having knob assemblies simultaneously grasped by one hand of an operator;

FIG. 2 is a cross-sectional view taken along the lines 2—2 of FIG. 3; and

FIG. 3 is an elevational view of a pair of side-by-side knob assemblies with the left-hand knob shown in cross section and the right-hand knob shown in full.

DESCRIPTION OF THE PREFERRED EMBODIMENT

Referring, generally, to FIG. 1, wherein a preferred form of the invention is illustrated, an operator 10 is shown seated on a seat 12 with his left hand 14 bridging the space between a pair of adjacent, aligned knob assemblies 20 with each knob assembly being carried by one of a pair of actuating levers 22. From FIG. 1, it can be seen that the operator can operate the levers 22, either simultaneously by grasping the knob assemblies 20,20, as shown, or individually by grasping the knob assembly 20 on one lever 22.

FIGS. 2 and 3 illustrate the details of the invention wherein the lever 22 has an end portion 26 which has an opening 28 extending from one face 30 of said end portion completely through to another face 32 thereof. The end surface 34 of the lever 22 faces axially upwardly with respect to the body of the lever.

Each knob assembly 20 is comprised of two parts or members 40 and 42. Member 40 has an elongate, substantially cylindrical-shaped body portion 44, which cylindrically-shaped body portion may be slightly conically tapered along the outer surface 47 thereof. The body portion 44 of member 40 has an axially outwardly projecting portion 46 which forms a shoulder 48 with respect to the end wall 50 of the member 40. As shown, the projecting portion 46 is a pin which is secured in an aperture 52 in the body portion 44 of the member 40 and is permanently secured therein. It is to be understood that the projecting portion 46 could be integrally formed with respect to the body portion 44 without departing from the spirit of the invention.

Formed around a peripheral portion of the end wall 50 of the body portion 44 of the member 40 is an axially, outwardly extending, arcuately-shaped extension 54. The extension 54 is shaped to conform with the shape of the outer periphery of the cylindrical body portion 44 with a slot or opening 56 formed through one segment thereof, as can best be seen in FIG. 2. When the projecting portion 46 of member 40 is inserted in the opening 28 in the end of the lever 22, the slot or opening 56 in the arcuate extension 54 bridges the opposite sides of the actuating lever 22 and substantially encircles the end portion 26 of the lever.

The other member 42 of the knob assembly 20 has a circular disc-shaped body portion 60 which has a slightly conically tapered outer surface 61 formed on said body portion. An axially projecting portion 62 is formed symmetrically about the axis of the disc-shaped body portion 60 and extends axially outwardly to form a shoulder 64 with respect to the end wall 66 of said member 42. The outer diameter of the projecting portion 62 is substantially equal to the internal diameter of the opening 28 in the end portion 26 of the lever 22 and is adapted to be inserted in said opening 28 in aligned face-to-face relationship with the projecting portion 46 on the member 40.

A fastener 70, such as a tapered headed bolt, has threads 72 formed on one end and a slot 74 formed in the tapered head 76 of the other end. The bolt 70 is passed through an opening 78 formed in the body portion 60 and is threaded into the threaded opening 80 in the projecting portion 46 of the member 40. A countersunk opening 82 is formed in the outer face of the disc-shaped body portion 60 of member 42 so that when the fastener 70 is completely seated, the head 76 of the fastener 70 will be nested in the countersunk opening 82 with the outer surface of the head 76 of the fastener being substantially flush with the outer surface of the disc-shaped body portion 60 of member 42. The fastening means will draw the members 40 and 42 together with the shoulders 48 and 64 seated in the opening 28 in the end portion 26 of the lever 22 whereby the knob assembly 20 is secured on the end portion 26 of the lever 22. The extension 54 on the member 40 projects over the end surface of the lever 22 and stops just short of abutting the end wall 66 of the disc-shaped body portion 60 of member 42, thereby completely protecting the outer end surface of the lever 22 from contact with the hand 14 of an operator 10.

In practice, the levers 22 generally are painted a bright color, such as yellow or orange, with the color of the knob assembly 20 being black. With the improved knob assembly 20 having the arcuate extension 54 encircling the end of the shaft, you do not see the yellow end of the lever 22 between the two black members of the knob 20, resulting in a more pleasing and aesthetically more acceptable appearance. With the improved form, the black knob assemblies 20 contrast with the yellow or orange levers 22 immediately identifying the location of the knob relative to the lever even without looking directly at the knob. An operator instinctively reaches for the knobs, sometimes without even looking, and, with the all black knob assembly on the end of the yellow lever, he will more accurately sense the location of the knob thereby improving his operation of the vehicle.

The improved knob assembly, when mounted disc-shaped member 60 to disc-shaped member 60 on two adjacent actuating levers 22, makes it possible for an operator's hand to bridge the gap between the knob assemblies 20 so that the two levers 22 can be operated simultaneously. A skilled operator can also rotate his hand in such a way as to advance one knob assembly 20 and lever 22 while retarding the other knob assembly 20 and lever 22 to accomplish, for instance, a left turn maneuver on a tractor-type vehicle. More extreme positioning of the one knob assembly with respect to the other knob assembly, may necessitate abandoning one knob assembly while the other knob assembly is grasped completely by the hand and moved relative to the first knob assembly. Generally, this can all be done with the one hand of the operator. The arcuate extension over the end of the shaft protects the end of the shaft against corrosion and rusting, which likewise protects the hand of the operator from grasping the rusted or corroded part of the lever.

The embodiments of the invention in which an exclusive property or privilege is claimed are defined as follows:

1. In a knob assembly carried by an end portion of an actuating lever, said knob assembly comprising a pair of shaped members, each member having a projecting portion, said projecting portions being seated in an opening in said end portion of the lever from opposite sides thereof, a fastener extending between said projecting portions of said members to secure said members to opposite sides of said lever, and means extending outwardly from one of said members in overlapping relationship to an exposed end of said lever whereby said end of the lever is protected from contact by the hand of an operator.

2. In the knob assembly of claim 1 wherein said means is an extension of said one of said members and is integrally formed therewith.

3. In the knob assembly of claim 2 wherein said extension is arcuate in shape and encompasses the end and closely associated sides of said lever.

4. In the knob assembly of claim 1 wherein said fastener is a threaded bolt being threaded into said one of said members after passing through an aperture in the other member for securing the members to said lever.

5. In the knob assembly of claim 1 wherein said one of said members has an elongate cylindrically-shaped body portion, and said other member has a circular disc-shaped body portion.

6. In the knob assembly as claimed in claim 5 wherein said projecting portions extend axially from said body portions.

7. In the knob assembly as claimed in claim 6 wherein said means is an extension and is arcuate in shape, said extension projects parallel to the axis and axially outward from the circumferential portion of said elongate cylindrically-shaped body portion.

8. In the knob assembly as claimed in claim 7 wherein said extension projects outwardly a distance just short of the thickness of said end portion of said lever.

9. In a knob assembly carried by an end portion of an actuating lever, said knob assembly comprising a pair of shaped members, each member having a projecting portion forming a shoulder with respect to the end wall of the member, said projecting portions seating in face-to-face relationship in an opening in said end portion of the lever, a fastener extending between said projecting portions of said members to secure said members to opposite sides of said lever with said shoulders seated in said opening in said lever, and extension means outwardly directed from said end wall of one of said members, said extension means being in overlapping relationship to the shoulder on said member and in overlapping relationship to an exposed end of said lever whereby said end of the lever is protected from contact.

10. In the knob assembly of claim 9 wherein said extension means is integrally formed with said one member.

11. In the knob assembly of claim 10 wherein said extension means is arcuate in shape and encompasses the end and closely associated sides of said lever.

12. In the knob assembly of claim 9 wherein said projecting portion of said one of said members is a separate pin secured in said one of said members.

13. In the knob assembly of claim 9 wherein one of said members has an elongate cylindrically-shaped body portion, and said member has a circular disc-shaped body portion.

14. In the knob assembly as claimed in claim 13 wherein said extension means is arcuate in shape and projects parallel to the axis and axially outward from the peripheral portion of said end wall of the elongate cylindrically-shaped body portion.

15. In the knob assembly as claimed in claim 14 wherein said extension means projects outwardly from said end wall a distance just short of the thickness of said end portion of said lever.

* * * * *